US009796548B2

(12) United States Patent
Veis et al.

(10) Patent No.: US 9,796,548 B2
(45) Date of Patent: Oct. 24, 2017

(54) PRINT MEDIA TRANSPORT APPARATUS

(71) Applicant: Hewlett-Packard Industrial Printing LTD, Netanya (IL)

(72) Inventors: Alex Veis, Kadima (IL); Yuval Dim, Moshav Haniel (IL)

(73) Assignee: HP SCITEX LTD., Netanya (IL)

( * ) Notice: Subject to any disclaimer, the term of this patent is extended or adjusted under 35 U.S.C. 154(b) by 0 days.

(21) Appl. No.: 15/221,469

(22) Filed: Jul. 27, 2016

(65) Prior Publication Data

US 2017/0029228 A1 Feb. 2, 2017

(30) Foreign Application Priority Data

Jul. 31, 2015 (EP) ..... 15179407

(51) Int. Cl.

| | |
|---|---|
| ***B65H 7/20*** | (2006.01) |
| ***B41J 11/06*** | (2006.01) |
| ***B41J 13/00*** | (2006.01) |
| ***B65H 5/04*** | (2006.01) |

(52) U.S. Cl.

CPC ..... *B65H 7/20* (2013.01); *B41J 11/06* (2013.01); *B41J 13/0009* (2013.01); *B65H 5/04* (2013.01); *B65H 2405/352* (2013.01); *B65H 2405/36* (2013.01); *B65H 2801/03* (2013.01)

(58) Field of Classification Search

CPC ..... B65H 7/20; B65H 5/04; B65H 2405/36; B65H 2405/352; B65H 2801/03; B41J 13/0009; B41J 11/06

See application file for complete search history.

(56) References Cited

U.S. PATENT DOCUMENTS

| | | | | |
|---|---|---|---|---|
| 5,921,368 | A | 7/1999 | Zaguroli | |
| 6,126,384 | A | 10/2000 | Darcy et al. | |
| 9,056,620 | B2 | 6/2015 | Copus | |
| 2004/0188927 | A1 | 9/2004 | Tanabe | |
| 2009/0244243 | A1* | 10/2009 | Nakagawa | B41J 3/28 347/104 |
| 2009/0295080 | A1* | 12/2009 | Sakai | B41J 11/06 271/264 |
| 2010/0225719 | A1 | 9/2010 | Takatsuka | |
| 2016/0129699 | A1* | 5/2016 | Dekel | B41J 11/007 347/104 |
| 2016/0288153 | A1* | 10/2016 | Shinoda | B05C 5/0291 |

FOREIGN PATENT DOCUMENTS

JP 2010-201817 9/2010

OTHER PUBLICATIONS

Berlin, A et al~"Paper Transport Using Modulated Airjet Arrays"~NIP & Digital Fabrication Conference~1999~2 pages.

* cited by examiner

*Primary Examiner* — David H Bollinger
(74) *Attorney, Agent, or Firm* — HP Inc. Patent Department

(57) ABSTRACT

In an example, a print media transport apparatus comprises a plurality of pallets having a self-propulsion mechanism, and being to support print media. The pallets may circulate on an endless track comprising a printing zone, a descending zone and an ascending zone. A controller may control the self-propulsion mechanisms of the pallets such that a pallet on the descending zone is at least partially supported by another pallet which is ahead on the track, and a pallet on the ascending zone is at least partially driven by pallet which follows on the track.

15 Claims, 3 Drawing Sheets

PRINT MEDIA TRANSPORT APPARATUS

CROSS-REFERENCE TO RELATED APPLICATION

This application claims priority to European Patent Application No. 15179407.0, filed on Jul. 31, 2015 and entitled "PRINT MEDIA TRANSPORT APPARATUS," which is hereby incorporated by reference in its entirety.

BACKGROUND

In some printers, print media transport apparatus such as belt-type conveyors or pallets on an endless track are used to convey media on to which text or an image may be printed. For example, such print media transport apparatus may be used to convey media from a media storage area to a position in which it can be printed (for example, near a printhead of the printer or the like) and then to convey the media to a collection area.

BRIEF DESCRIPTION OF DRAWINGS

Examples will now be described, by way of non-limiting example, with reference to the accompanying drawings, in which.

DETAILED DESCRIPTION

Figure 1:
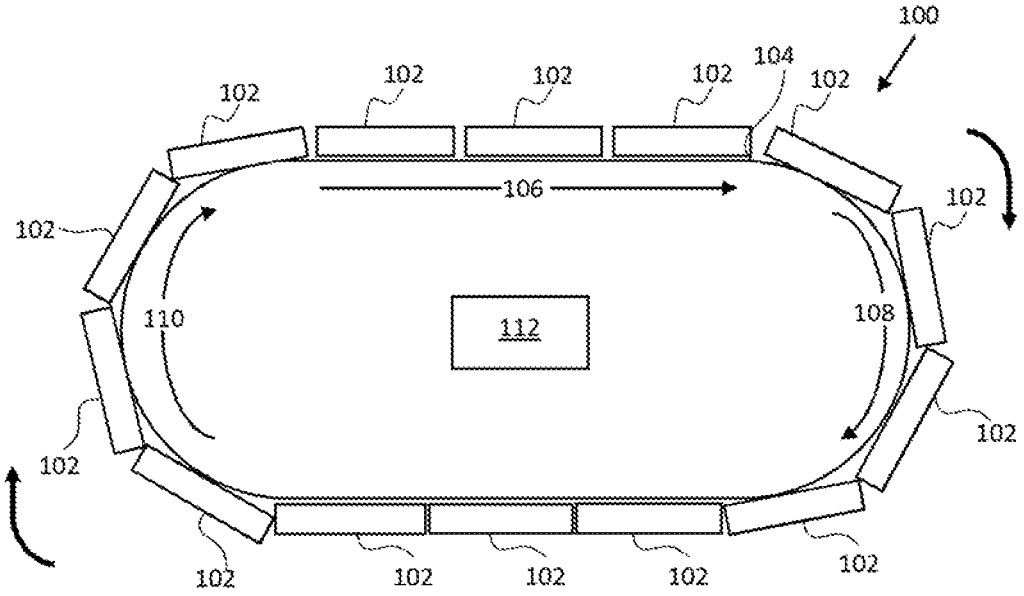
FIG. 1 is a simplified schematic of an example of a print media transport apparatus.

FIG. 1 shows a block diagram of an example of a print media transport apparatus 100 comprising a plurality of pallets 102 which, as will be described in greater detail in relation to the example of FIG. 2 below, each have a self-propulsion mechanism, and are to support print media, i.e. a substrate to which a printed image, text or the like may be applied. Such print media may for example comprise a sheet material, such as paper, card stock, plastics, and the like, and may be rigid, substantially rigid or flexible.

The pallets 102 circulate on an endless track 104. The track 104 comprises a printing zone 106, a descending zone 108 and an ascending zone 110. In the example of FIG. 1, the pallets 102 circulate in a clockwise direction and the track 104 is substantially ovoid having a substantially horizontal printing zone 106 and a substantially horizontal return zone linking the descending zone 108 and the ascending zone 110. In other examples, other (for example more convoluted) tracks may be provided.

While print media is conveyed over the printing zone 106 of the track 104, inks, toners and the like may be applied to media supported by one or several pallets 102 by an associated printer (not shown). In some examples, pallets 102 on the printing zone 106 are controlled such that at least two pallets 102 move as a group across the printing zone 106 of the track 104 when supporting print media. Pallets 102 travelling on the printing zone 106 may thereby form a virtual table on which media is supported and carried relative to a printing mechanism of an associated printer. The printing mechanism may for example be associated with an ink supply and comprise a printhead mounted on a moveable carriage, an array of static printheads or the like. The printhead(s) may eject drops of ink through orifices or nozzles and towards a print media so as to print onto the media.

The apparatus 100 further comprises a controller 112 to control the self-propulsion mechanisms of the pallets 102, such that a pallet 102 on the descending zone 108 is at least partially supported by another pallet 102 which is ahead on the track 104, and a pallet 102 on the ascending zone 110 is at least partially driven by pallet 102 which follows on the track 104. The controller 112 may comprise processing apparatus, such as a computer or the like, and may execute machine readable instructions in order to control the movement of the pallets 102. In this example, the controller 112 is shown as part of the apparatus 100. In other examples, the controller 112 may be mounted on a pallet 102 (or the functions thereof may be distributed over several pallets 102), or the controller 112 may be separate, even remote, from the belt 104.

Figure 2:
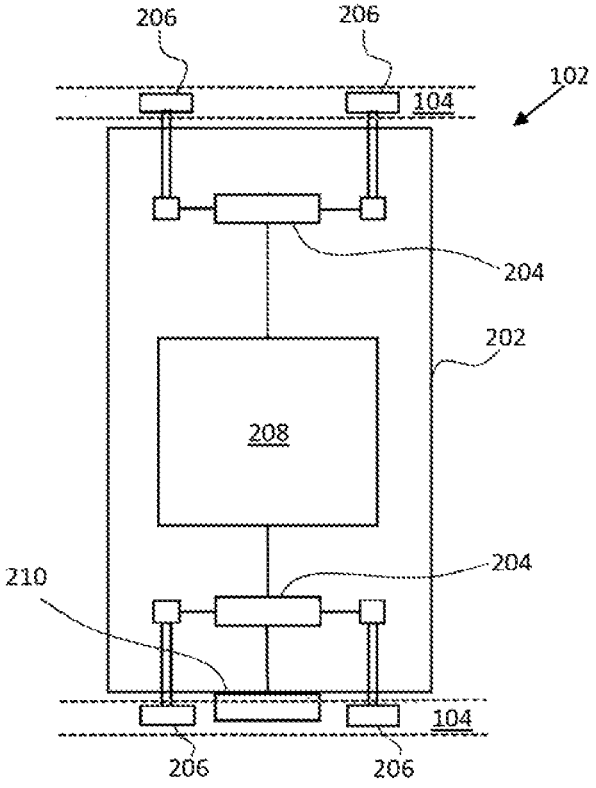
FIGS. 2 and 3 are simplified schematics of examples of pallets.

FIG. 2 shows an example of a pallet 102. In this example, the pallet 102 comprises a frame 202 and self-propulsion mechanism which comprises two linear motors 204 and control circuitry 208, which comprises motor drivers and some processing circuitry. The pallet 102 further comprises bearings 206 which are intended to run along the track 104 (which in this example comprises two spaced rails, which may be shaped so as to retain the bearings 206) supported by the frame 202 and driven by the motors 204. In other examples, other propulsion mechanisms (such as magnetic mechanisms or the like) may be used to provide the self-propulsion mechanism for a pallet 102. In this example the motor 204 is powered using power collected by brushes 210, which interact with a power supply loop (not shown). In other examples, the power may be provided in another manner, such as by a battery mounted on the pallet 102 or the like.

The motors 204 are controlled by the control circuitry 208, itself controlled by the controller 112 of the print media transport apparatus 100. In one example, processing apparatus within the control circuitry 208 and the controller 112 communicate wirelessly. Such communication may comprise commands such as start and stop commands, requests for status updates, and the like. The status updates may for example to be to provide feedback to control loops and readings acquired by any sensors (for example hall effect sensors) mounted on a pallet 102.

In an example, the control circuitry 208 and the controller 112 act to control the motion of the pallets 102 such that, while a pallet 102 is on the printing zone 106, the motion (e.g. speed and/or location) is controlled to within a tolerance band. This may be a relatively tight tolerance band as accurate motion allows for predictable application of Inks, toners and the like to media supported by the pallets 102. In some practical examples, the location of a pallet 102 is controlled to within 10 microns while on the printing zone 106 of the track 104. This may be, for example, to ensure that the pallet 102 places media at an appropriate location for a drop of ink or the like to land, based on the time at which the drop is emitted. In some examples, therefore the pallets 102 are individually controlled while a pallet is on the printing zone 106 in a precision mode. However, outside this zone 106, for example while a pallet 102 is on the descending or ascending zones 108, 110, the motion may be allowed to vary outside the tolerance band.

Figure 3:
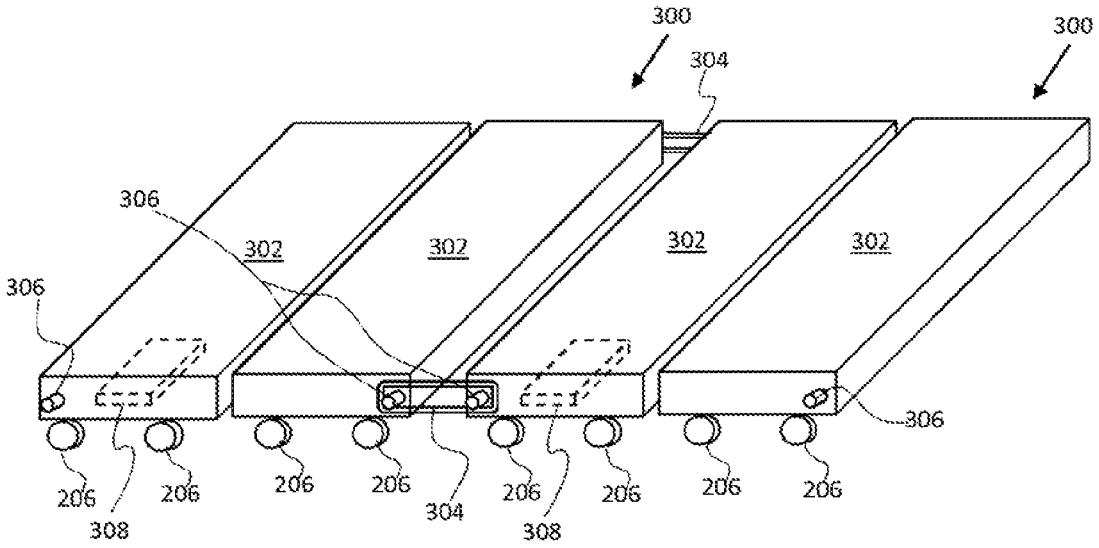

FIG. 3 shows an example in which two pallets 300 are coupled together. In this example the pallets 300 comprise two bar-like portions 302, the portions 302 being coupled in a substantially parallel configuration, the coupling allowing relative rotation between the portions 302. The pallets 300 are coupled to one another with a coupling allowing a variable spacing between the pallets 300. In this example, a slotted coupling 304 (for example, a metal coupling) connects pegs 306 provided on each pallet 300. The pegs 306 of the pallets 300 can be separated by the length of the slot in the slotted coupling 304, or the pallets 300 can move closer to one another until they are touching. The slotted coupling 304 also allows the pallets 300 to rotate relative to one another as they round the turns in the track 104. One of the portions 302 comprises a self-propulsion mechanism 308, the other being driven by the portion 302 having a self-propulsion mechanism 308. Such pallets 300 may be joined in an endless loop.

The self-propulsion mechanisms of the pallets 102, 300 may be controlled by the controller 112 such that, while pallets 102, 300 are on the printing zone 106 of the track 104, the spacing remains constant (which allows for accurate media placement within the printing zone) and, while a pallet 102, 300 is on the descending 108 and ascending 110 zones of the track 104, the spacing is at a minimum (i.e. the pallets 102, 300 are tightly packed and are acting directly on one another). The pallets 102, 300 may also be tightly packed while on the substantially horizontal return zone of the track 104 such that the pallets 102, 300 on the descending zone 108 can act on the pallets 102, 300 on the ascending zone 110 (and vice versa) indirectly, the ascending pallets 102, 300 acting as a counterbalance to the descending pallets 102, 300, as further explained below.

Figure 4:
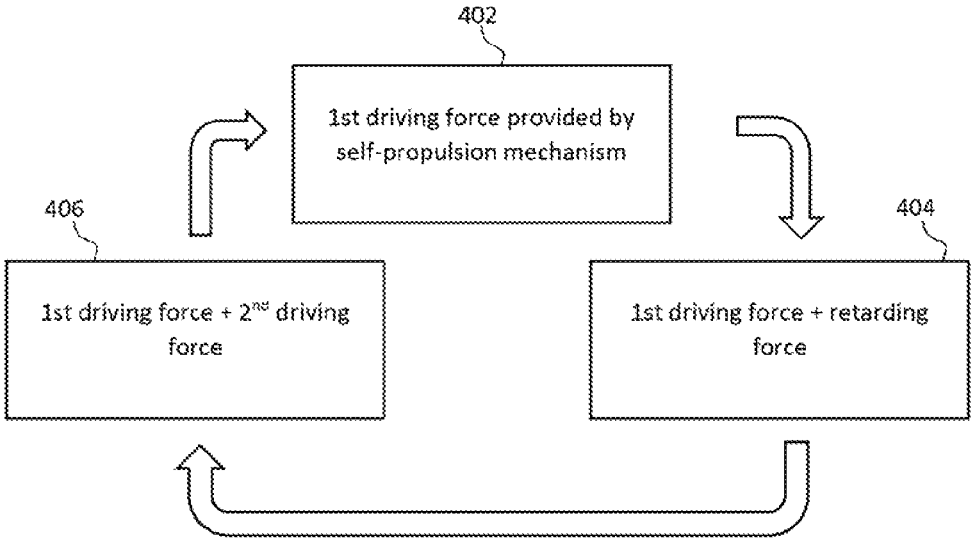
FIG. 4 is a flowchart of an example of a method of driving a pallet around a track.

Control of the pallets 102, 300 may be carried out as shown in the flow chart of FIG. 4. When a pallet 102, 300 is on the printing zone 106 of the track 104, it is driven with a first driving force provided by a self-propulsion mechanism of the pallet 102, 300 (block 402). In a descending portion 108 of a track, a retarding force is applied by at least one other pallet 102, 300 on the track 104 (bock 404). In at least the ascending zone 110 of the track, a second driving force is provided by at least one other pallet 102, 300 on the track 104 (block 406). This second driving force may be provided gravity acting on at least one pallet 102, 300 on the descending zone 108 of the track 104. The retarding force and/or the second driving force may be transmitted via at least one intermediate pallet 102, 300 between the pallet 102, 300 on the ascending zone 110 of the track 104 and the pallet 102, 300 on the descending zone 108 of the track 104 (i.e. via at least one intermediate pallet 102, 300 on the substantially horizontal return zone of the track 104).

Figure 5A:
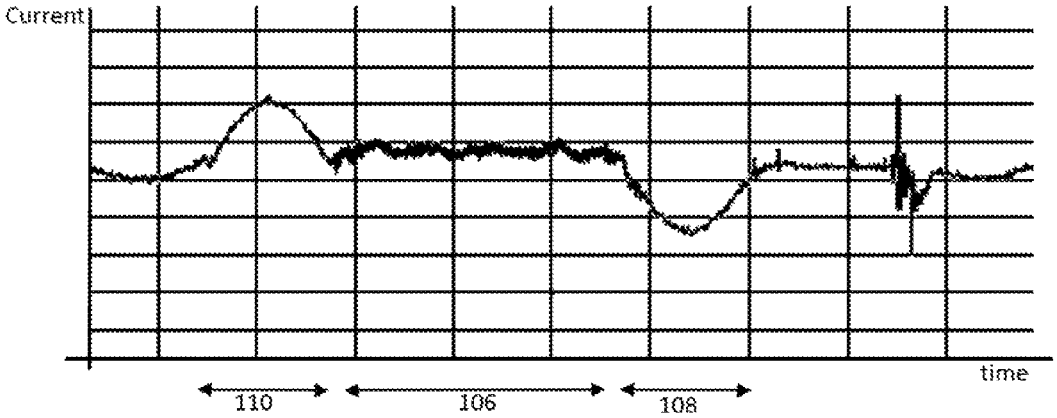
FIGS. 5*a* and 5*b* show the currents supplied to a pallet self-propulsion mechanism according to two example schemes for driving a pallet.
Figure 5B:
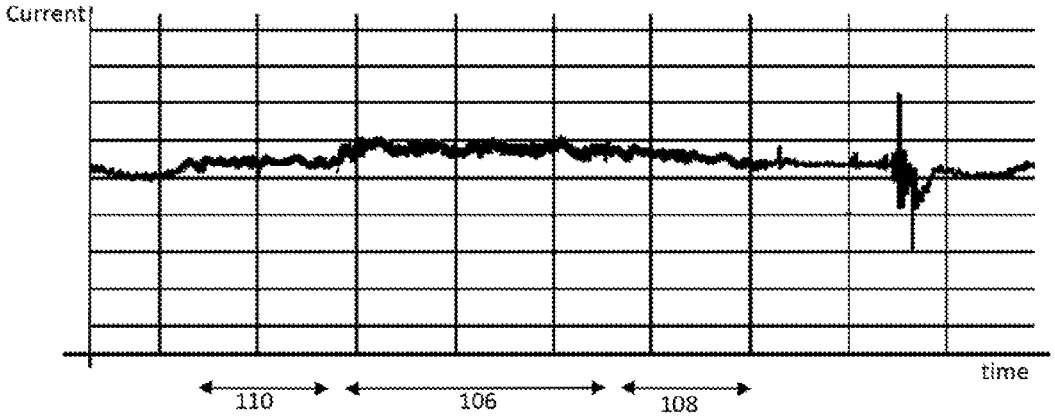

FIGS. 5*a* and 5*b* compare the current delivered to a self-propulsion mechanism according to two schemes for driving a pallet 102, 300. In the scheme shown in FIG. 5*a*, each pallet 102, 300 is driven by its self-propulsion mechanism in isolation. As can be seen, there are minor fluctuations where a control loop is compensating for friction and the like to place the pallet 102, 300 at an intended location. In addition, while a pallet is on the ascending zone 110 of the track, the current shows a peak as the pallet 102, 300 is driven to climb and overcome gravity. While a pallet 102, 300 is on the descending zone 108 of the track 104, the current shows a dip as gravity is resisted. These peak and trough currents are opposite in direction but each will result in additional heating of a motor and any associated drivers, which should be taken into account at the time the self-propulsion mechanism is designed. In addition, the motors of a self-propulsion mechanism are sized for these peak currents. For completeness, it is noted that the rapid, relatively large, fluctuation to the right of the graph is an artifact arising from a gap in the encoder used monitor the pallet location, and not a result of any control of the power/current levels. As can be seen from the Figure, the average current varies significantly between different zones of the track.

FIG. 5*b* shows the current delivered to drive a pallet 102, 300 according to examples of the methods set out herein, for example according to the flow chart of FIG. 4. In this example, the current variability is much lower—the average current being supplied in each zone 106, 108, 110 is more similar, in particular in the ascending 108 and descending 110 zones, being substantially constant, or equal between zones. Indeed, as can be seen by comparing FIGS. 5*a* and 5*b*, the current (and power) supplied to a self-propulsion mechanism of an individual pallet 102, 300 on the ascending zone 110 of track 104 is insufficient to allow that pallet 102, 300 to climb the ascending zone 110 of track 104 (an additional driving force supplied by the action of a descending pallet 102, 300 is employed). This in turn allows a lower specification of motor or the like to be used and/or reduces power consumption (and therefore cost of running an apparatus 100) and heating (potentially reducing maintenance burdens or increasing the life span of a self-propulsion mechanism) when compared to the scheme of FIG. 5*a*. In a practical example, supplying current as shown in FIG. 5*b* may result in a power saving of about ⅓ to ½ compared to the scheme illustrated in FIG. 5*a*.

The method of FIG. 4 may be achieved by supplying power or current to the propulsion mechanism of each pallet 102, 300 at a substantially constant average level for all zones of the track 104. The actual variability of the current will dependent on factors such as the friction encountered in an apparatus. However, in some examples, the current may be within a range of 50% of the average current. Moreover, the average current supplied while a pallet traverses a particular zone is substantially equal for all zones (or at least for the ascending and descending zones 108, 110). Effectively, ascending pallets 102, 300 will be pushed by following pallets 102, 300 and descending pallets 102, 300 will lean on preceding pallets 102, 300, which therefore provide a retarding force (or counter weight). This balances the driving currents across the phases of motion around the track 104.

Figure 6:
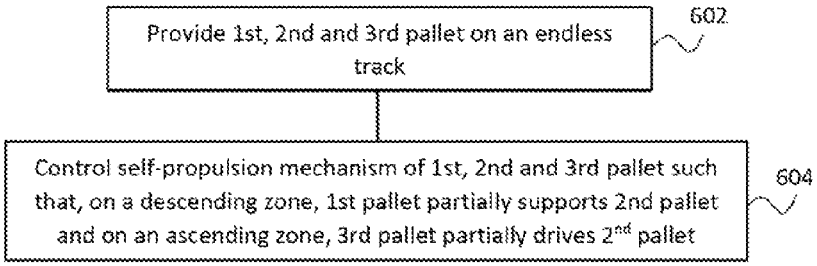
FIG. 6 is a flowchart of another example of a method of driving a pallet around a track.

Considered in another way, as shown in FIG. 6, in block 602, a first, second and third pallet 102, 300 are provided on an endless track 104 of a print media transport apparatus 100. The first pallet 102, 300 precedes the second pallet 102, 300 and the second pallet 102, 300 precedes the third pallet 102, 300. In block 604, a self-propulsion mechanism of each of the first, second and third pallet 102, 300 is controlled such that, on a descending zone 108 of the track 104, the first pallet 102, 300 at least partially supports the second pallet 102, 300 and on an ascending zone 110 of the track 104, the third pallet 102, 300 at least partially drives the second pallet 102, 300.

As noted above, while the pallet movements may be accurately controlled while a pallet 102, 300 is on the printing zone 106 of the track 104, this may be less of a concern in other zones of the track 104.

Examples in the present disclosure can be provided as methods, systems or machine readable instructions, such as any combination of software, hardware, firmware or the like, which may for example be executed by the controller 112 or the control circuitry 208. Such machine readable instructions may be included on a computer readable storage medium (including but is not limited to disc storage, CD-ROM, optical storage, etc.) having computer readable program codes therein or thereon. The machine readable instructions may, for example, be executed by a general purpose computer, a special purpose computer, an embedded processor or processors of other programmable data processing devices to realize the functions of the controller 112 and/or control circuitry 208 described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Further, the teachings herein may be implemented in the form of a computer software product, the computer software product being stored in a storage medium and comprising a plurality of instructions for making a computer device implement the methods recited in the examples of the present disclosure.

The present disclosure is described with reference to flow diagrams. Although the flow diagrams described above show a specific order of execution, the order of execution may differ from that which is depicted. It shall be understood that each block in the flow diagrams, as well as combinations thereof can be realized by machine readable instructions.

Features described in relation to one example may be combined with features described in relation to any other example. Thus, a feature described in relation to a pallet 102 as shown in FIG. 2, may be present on a pallet 300 as shown in FIG. 3, and vice versa.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A print media transport apparatus comprising:

a plurality of pallets, each having a self-propulsion mechanism and being to support print media;

an endless track on which the plurality of pallets circulate, the track comprising a printing zone, a descending zone and an ascending zone, a controller to control the self-propulsion mechanisms of each of the pallets such that a pallet on the descending zone is at least partially supported by another pallet which is ahead on the track, and a pallet on the ascending zone is at least partially driven by pallet which follows on the track.

2. A print media transport apparatus according to claim 1 in which pallets are linked in an endless loop, the pallets being coupled with a coupling allowing a variable spacing between the pallets, wherein controller is to drive the pallets such:

while a pallet is on the printing zone of the track, the spacing remains constant, and, while a pallet is on the descending and ascending zones of the track, the spacing is at a minimum.

3. A print media transport apparatus according to claim 1 in which the controller is to control the speed of the pallets such that, while a pallet is on the printing zone of the track, the speed is maintained to within a tolerance band, and, in another zone of the track, the speed varies outside the tolerance band.

4. A print media transport apparatus according to claim 1 in which each pallet comprises at least two portions, the portions being coupled in a substantially parallel configuration, the coupling allowing relative rotation between the portions.

5. A print media transport apparatus according to claim 4 in which the self-propulsion mechanism is mounted on one of the portions.

6. A method comprising:

driving a first pallet around an endless track upon which a plurality of coupled pallets circulate, the endless track having an ascending zone and a descending zone and being associated with a printer, and the plurality of pallets being to convey print media to be printed by the printer, the method comprising driving the first pallet with a first driving force provided by a self-propulsion mechanism of the first pallet and, in at least the ascending zone of the track, a second driving force provided by at least one other pallet on the track.

7. A method according to claim 6 in which the second driving force is provided by gravity acting on at least one pallet on the descending zone of the track.

8. A method according to claim 7, in which the second driving force is transmitted via at least one intermediate pallet between the pallet on the ascending zone of the track and the pallet on the descending zone of the track.

9. A method according to claim 6 comprising supplying power to the self-propulsion mechanism of the first pallet at a substantially constant average level for all zones of the track.

10. A method according to claim 6 in which, while a pallet is on descending zone of the track, a retarding force is applied thereto by at least one other pallet on the track.

11. A method, comprising providing a first, second and third pallet on an endless track of a print media transport apparatus, wherein the first pallet precedes and is coupled with the second pallet and the second pallet precedes and is coupled with the third pallet;

controlling a self-propulsion mechanism of each of the first, second and third pallet on the endless track such that, on a descending zone of the track, the first pallet at least partially supports the second pallet and on an ascending zone of the track, the third pallet at least partially drives the second pallet.

12. A method according to claim 11 wherein controlling the self-propulsion mechanism comprises controlling the power supplied to the self-propulsion mechanism such that the average power is approximately equal for the descending and ascending zones of the track.

13. A method according to claim 11 wherein controlling the self-propulsion mechanism comprises controlling the current supplied to the self-propulsion mechanism such that the average current is approximately equal for the descending and ascending zones of the track.

14. A method according to claim 11 wherein controlling the self-propulsion mechanism comprises controlling the power supplied to the self-propulsion mechanism such that the power supplied to an individual pallet on the ascending zone of track is insufficient to allow that pallet to climb the ascending zone of track.

15. A method according to claim 11 in which the pallets are intended to support a print media during application of print materials thereto, the method comprising controlling the position of the pallets such that at least two pallets move as a group across a horizontal zone of a track when supporting print media.

* * * * *